US009523477B2

(12) United States Patent
Lin

(10) Patent No.: US 9,523,477 B2
(45) Date of Patent: Dec. 20, 2016

(54) VEHICLE LAMP HAVING LIGHT BAR

(71) Applicant: HON HAI PRECISION INDUSTRY CO., LTD., New Taipei (TW)

(72) Inventor: Chen-Han Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 23 days.

(21) Appl. No.: 14/575,137

(22) Filed: Dec. 18, 2014

(65) Prior Publication Data

US 2016/0076725 A1 Mar. 17, 2016

(30) Foreign Application Priority Data

Sep. 11, 2014 (TW) ..... 103131291 A

(51) Int. Cl.
*F21V 9/00* (2015.01)
*F21S 8/10* (2006.01)

(52) U.S. Cl.
CPC ..... *F21S 48/328* (2013.01); *F21S 48/115* (2013.01); *F21S 48/1317* (2013.01); *F21S 48/211* (2013.01); *F21S 48/215* (2013.01); *F21S 48/225* (2013.01); *F21S 48/2237* (2013.01); *F21S 48/2268* (2013.01); *F21S 48/2281* (2013.01)

(58) Field of Classification Search
CPC ..... F21S 48/328; F21S 48/1317; F21S 48/115
USPC ..... 362/516, 509, 511, 611, 612, 628, 551
See application file for complete search history.

(56) References Cited

U.S. PATENT DOCUMENTS

| | | | | |
|---|---|---|---|---|
| 5,711,592 | A * | 1/1998 | Hotta | B60Q 1/302 359/15 |
| 2009/0052205 | A1* | 2/2009 | Chen | G02B 6/001 362/612 |
| 2010/0027286 | A1* | 2/2010 | Lin | G02B 6/0011 362/551 |
| 2010/0128496 | A1* | 5/2010 | Chang | G02B 6/0015 362/628 |
| 2011/0228517 | A1* | 9/2011 | Kawabat | F21K 9/00 362/84 |
| 2013/0077285 | A1* | 3/2013 | Isogai | F21K 9/135 362/84 |

* cited by examiner

*Primary Examiner* — Anh Mai
*Assistant Examiner* — Glenn Zimmerman
(74) *Attorney, Agent, or Firm* — Zhigang Ma

(57) ABSTRACT

A vehicle lamp includes a light bar, a plurality of circuit boards, a plurality of light emitting diode (LED) elements and a heat dissipating structure. The light bar has an annular top surface and an annular bottom surface. A coupling portion is formed on the bottom surface of the light bar. The LED elements are arranged on the circuit board. Light emitted from the LED elements are incident into the light bar through the coupling portion. The heat dissipating structure is coupled to the light bar with the LED elements and the circuit boards mounted between the light bar and the heat dissipating structure.

14 Claims, 3 Drawing Sheets

VEHICLE LAMP HAVING LIGHT BAR

CROSS-REFERENCE TO RELATED APPLICATIONS

This application claims priority to Taiwan Patent Application No. 103131291 filed on Sep. 11, 2014, the contents of which are incorporated by reference herein.

FIELD

The disclosure relates to a vehicle lamp, and particularly to a closed annular vehicle lamp with light emitting diode (LED) elements.

BACKGROUND

A heat dissipating structure is used for dissipating heat generated from LED elements, which will damage a closed annular structure of a vehicle lamp.

BRIEF DESCRIPTION OF THE DRAWINGS

Implementations of the present technology will now be described, by way of example only, with reference to the attached figures.

DETAILED DESCRIPTION

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Figure 1:
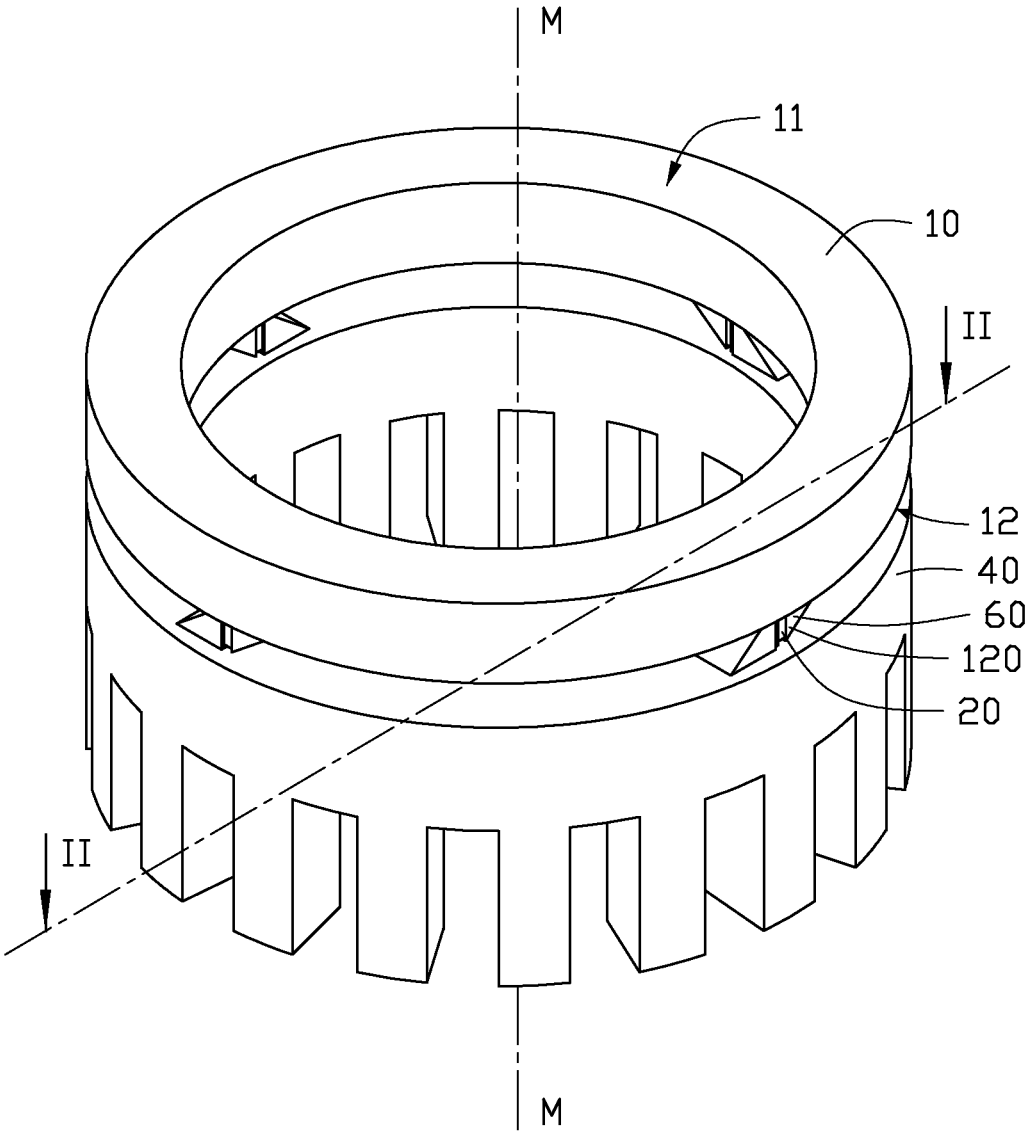
FIG. 1 is an isometric view of a vehicle lamp in accordance with an exemplary embodiment of the present disclosure.
Figure 2:
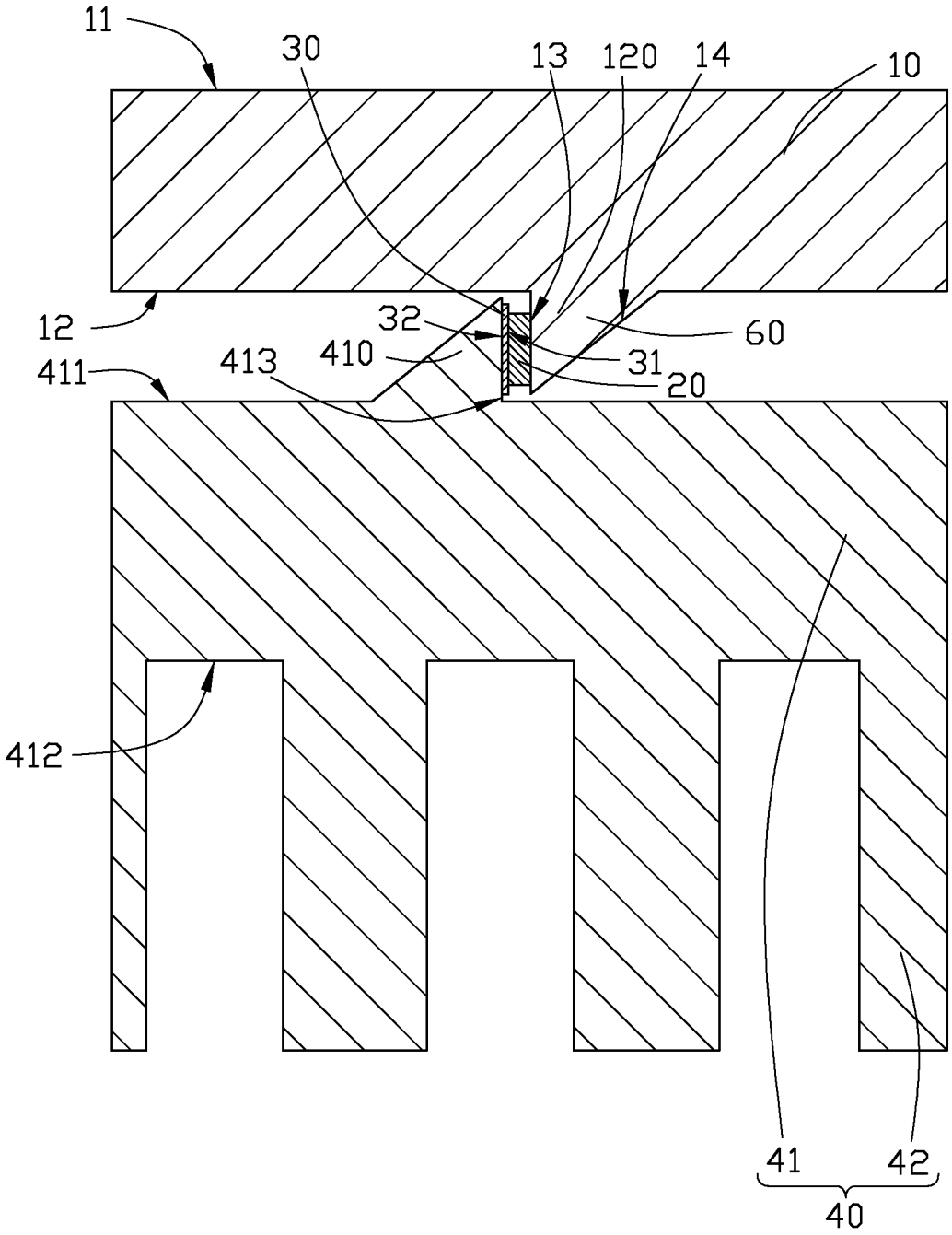
FIG. 2 is a cross-sectional view of a vehicle lamp in accordance with a first exemplary embodiment of the present disclosure of FIG. 1.

Referring to FIGS. 1 and 2, a vehicle lamp comprises a light bar 10, a plurality of light emitting diode (LED) elements 20, a plurality of circuit boards 30 and a heat dissipating structure 40. The LED elements 20 are arranged on the circuit boards 30 and coupled to the light bar 10. The heat dissipating structure 40 is coupled to the light bar 10 with the LED elements 20 and the circuit boards 30 mounted between the light bar 10 and the heat dissipating structure 40.

The light bar 10 is a closed annular structure. The light bar 10 has an annular top surface 11 and an annular bottom surface 12. The top surface 11 is opposite to the bottom surface 12. The top surface 11 and the bottom surface 12 can be coaxial. The top surface 11 is a light extraction surface of the light bar 10. The bottom surface 12 is a reflective surface coupled to the LED elements 20. Light emitted from the LED elements 20 can penetrate into the light bar 10 through the bottom surface 12, and can extract from the light bar 10 through the top surface 11. The top surface 11 and the bottom surface 12 are perpendicular to a symmetry axis M-M of the light bar 10.

The LED elements 20 are coupled to the bottom surface 12 of the light bar 10 via a coupling portion 60. Light emitted from the LED elements is incident into the light bar 10 through the coupling portion 60. The coupling portion 60 is formed on the bottom surface 12. The coupling portion 60 comprises a plurality of first bulges 120 protruding from the bottom surface 12. In at least one embodiment, the LED elements 20 each can be arranged on one of the first bulges 120. Each first bulge 120 protrudes from the bottom surface 12. Each first bulge 120 is a wedge structure. Each bugle 120 comprises a light incident surface 13 and a light reflecting surface 14. The LED elements 20 face the light incident surfaces 13. Specially, each LED element 20 is attached to the light incident surface 13 of each first bugle 120. Light emitted from the LED element 20 can directly strike on the light incident surface 13 and penetrate into the light bar 10. The light incident surface 13 is perpendicular to the bottom surface 12. The light incident surface 13 extends along a radial direction of the annual light bar 10. In other words, the light incident surface 13 can be coplanar with the symmetry axis M-M of the light bar 10. The light reflecting surface 14 is a reflective surface. The light reflecting surface 14 can be a flat plane surface or a curved surface.

Light emitted from the LED elements 20 penetrates into the light bar 10 from the light incident surface 13, and then is reflected by the light reflecting surface 14, and extracts from the light bar 10 through the top surface 11. A part of light can spread in the light bar 10 via being reflected between the top surface 11 and the bottom surface 12 several times, and finally can extract from the light bar 10 through the top surface 11.

Figure 3:
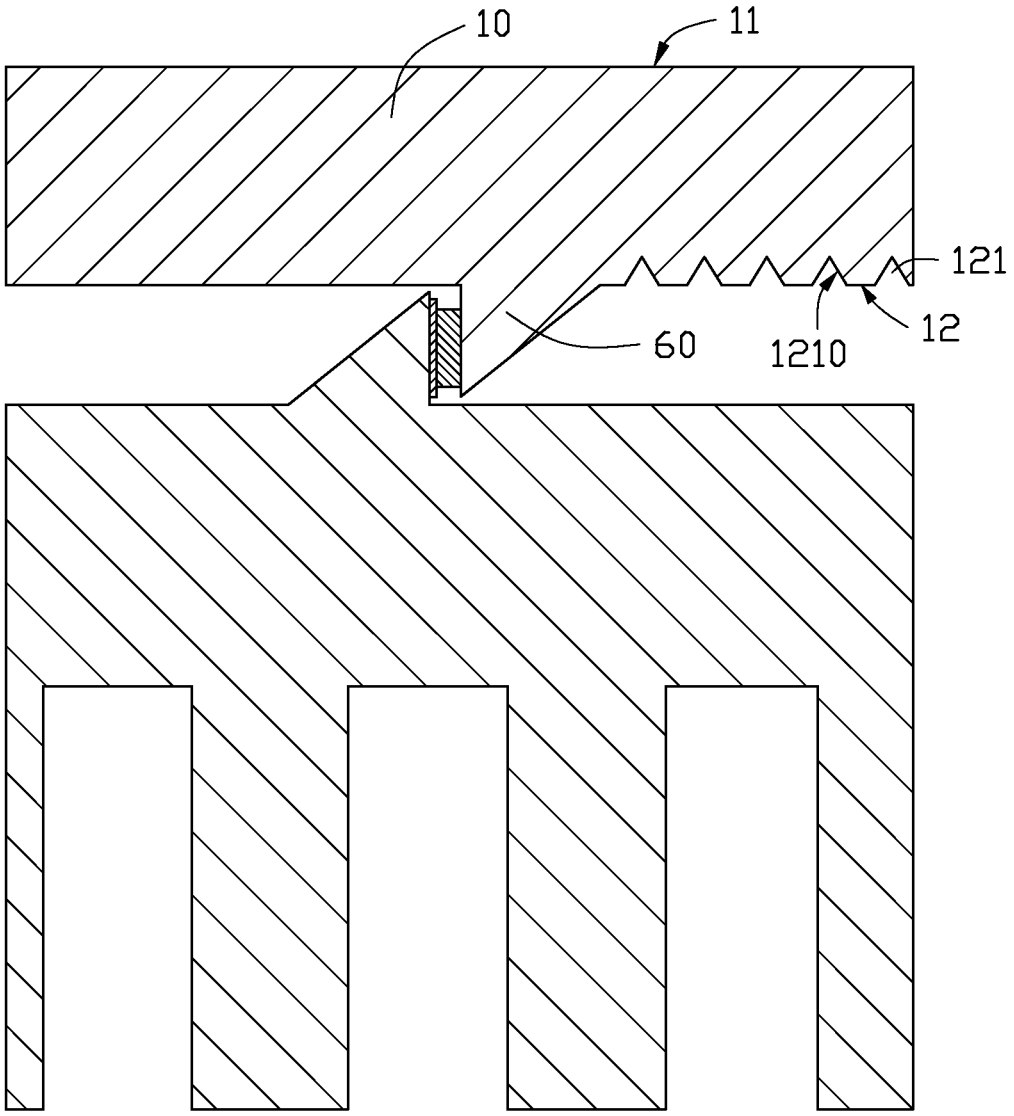
FIG. 3 is a cross-sectional view of a vehicle lamp in accordance with a second exemplary embodiment of the present disclosure of FIG. 1.

Referring to FIG. 3, the bottom surface 12 can further comprise a plurality of recesses 121. Each recess 121 has a plurality of oblique surfaces 1210. The oblique surfaces 1210 of each recess 121 can be a reflective surface.

Each circuit board 30 comprises a first side 31 and a second side 32. The first side 31 is opposite to the second side 32. The LED elements 20 are arranged on and electrically connected to the first sides 31 of the circuit boards 30. The heat dissipating structure 40 is coupled to the circuit boards 30. In this embodiment, the heat dissipating structure 40 can be coupled to the second sides 32 of the circuit boards 30.

The heat dissipating structure 40 comprises a heat collecting structure 41 and a plurality of fins 42 formed on the heat collecting structure 41. The heat collecting structure 41 is attached to the second sides 32 of the circuit boards 30. The heat dissipating structure 40 can be made of metal or ceramic. The heat dissipating structure 40 can be made of aluminum or copper.

The heat collecting structure 41 can be a closed annular structure. The heat collecting structure 41 comprises an upper surface 411 and a lower surface 412 opposite to the upper surface 411. The upper surface 411 is coupled to the second sides 32 of the circuit boards 30. In this embodiment, the upper surface 411 comprises a plurality of second bulges 410. The second bulges 410 are coupled to the second sides 32 of the circuit boards 30. Each bulge 410 comprises a structure surface 413. The structure surfaces 413 are attached to the second sides 32 of the circuit boards 30. The structure surface 413 is perpendicular to the upper surface 411 of the heat collecting structure 41.

The fins 42 are formed on the lower surface 412 of the heat collecting structure 41. The fins 42 are spaced from each other and extended from the lower surface 412 away from the upper surface 411 perpendicularly.

The embodiments shown and described above are only examples. Many details are often found in the art such as the other features of a vehicle lamp. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A vehicle lamp comprising:

a light bar having an annular top surface and an annular bottom surface opposite to the top surface;

a coupling portion formed on the bottom surface of the light bar;

a plurality of circuit boards;

a plurality of light emitting diode (LED) elements arranged on the circuit boards, light emitted from the LED elements being incident into the light bar through the coupling portion; and a heat dissipating structure coupled to the light bar with the LED elements and the circuit boards mounted between the light bar and the heat dissipating structure;

wherein the coupling portion comprises a plurality of first bulges protruding from the bottom surface, the LED elements are coupled to the bottom surface via the coupling portion, each first bulge is a wedge structure, each first bulges comprises a light incident surface and a light reflecting surface, the light incident surface is perpendicular to the bottom surface, the LED elements face the light incident surfaces.

2. The vehicle lamp of claim 1, wherein the top surface and the bottom surface are perpendicular to a symmetry axis of the light bar.

3. The vehicle lamp of claim 1, wherein the light incident surface is coplanar to the symmetry axis of the light bar.

4. The vehicle lamp of claim 1, wherein the bottom surface further comprises a plurality of recesses, each recess has a plurality of oblique surfaces.

5. The vehicle lamp of claim 1, wherein the heat dissipating structure comprises a heat collecting structure and a plurality of fins formed on the heat collecting structure, and the heat collecting structure is coupled to the circuit boards.

6. The vehicle lamp of claim 3, wherein the light reflecting surface is a flat plane surface or a curved surface.

7. The vehicle lamp of claim 4, wherein the oblique surfaces of each recess is a reflective surface.

8. The vehicle lamp of claim 5, wherein the heat collecting structure is a closed annular structure.

9. The vehicle lamp of claim 8, wherein the heat collecting structure comprises a upper surface and a lower surface opposite to the upper surface, the upper surface is coupled to the second sides of the circuit boards.

10. The vehicle lamp of claim 9, wherein the upper surface comprises a plurality of second bulges, the second bulges are coupled to the second sides of the circuit boards.

11. The vehicle lamp of claim 9, wherein the fins are formed on the lower surface of the heat collecting structure.

12. The vehicle lamp of claim 10, wherein each bulge comprises a structure surface, and the structure surfaces are attached to the second sides of the circuit boards.

13. The vehicle lamp of claim 11, wherein the fins are spaced from each other and extended from the lower surface away from the upper surface perpendicularly.

14. The vehicle lamp of claim 12, wherein each structure surface is perpendicular to the upper surface of the heat collecting structure.

* * * * *